United States Patent [19]

Breglia et al.

[11] 4,019,262

[45] Apr. 26, 1977

[54] DIRECT FIRE WEAPON TRAINER INCORPORATING HIT AND DATA DELAY RESPONSES

[75] Inventors: Denis R. Breglia, Altamonte Springs; Alfred H. Rodemann, Maitland; David T. Long, Oviedo, all of Fla.

[73] Assignee: The United States of America as represented by the Secretary of the Navy, Washington, D.C.

[22] Filed: Dec. 22, 1975

[21] Appl. No.: 642,880

[52] U.S. Cl. ..... 35/25; 273/101.1

[51] Int. Cl.$^2$ ..... F41G 3/26

[58] Field of Search ..... 35/11 A, 11 R, 25, 10.2, 35/125; 273/101.1, 101.2; 235/61.5 S, 92 R

[56] References Cited

UNITED STATES PATENTS

| | | | |
|---|---|---|---|
| 2,860,423 | 11/1958 | Dehmel | 35/12 S |
| 3,422,548 | 1/1969 | Waldhäuser, Jr. | 35/25 |
| 3,729,129 | 4/1973 | Fletcher et al. | 235/92 R |
| 3,748,751 | 7/1973 | Breglia et al. | 35/25 |
| 3,798,795 | 3/1974 | Michelsen | 35/25 |
| 3,882,496 | 5/1975 | Lewis et al. | 35/25 X |
| 3,888,022 | 6/1975 | Pardes | 35/25 |
| 3,892,352 | 7/1975 | Eglin | 235/61.5 S |
| 3,916,536 | 11/1975 | Mohon et al. | 35/25 |

FOREIGN PATENTS OR APPLICATIONS

| | | | |
|---|---|---|---|
| 1,117,846 | 6/1968 | United Kingdom | 35/25 |

*Primary Examiner*—Richard C. Pinkham
*Assistant Examiner*—Vance Y. Hum
*Attorney, Agent, or Firm*—Richard S. Sciascia; John W. Pease; Don D. Doty

[57] ABSTRACT

A laser type direct fire weapon simulator for action against a moving image display wherein the weapon is slaved connected to variable voltage producing devices such as potentiometers to provide voltage outputs corresponding to azimuth and elevation positions of the weapon, a voltage responsive beam deflector system for varying the direction of the laser beam on the display target in accordance with the azimuth and elevation voltages, a continuous reading delay monitor responsive to a delay voltage derived from the elevation voltage to provide prior time readout voltage data to an electro-optical system directing the laser beam such that when actuated the system shows the location where a missile would have hit allowing for delay time corresponding to elevation voltage, together with a delay trigger circuit which delays the display of the hit until the elapse of missile flight time corresponding again to elevation voltage and hence range. The invention further contemplates adder circuits and instructor adjustable voltage input sources to vary the azimuth and elevation inputs to the electro-optical system corresponding to selected v-parallax and ballistic data.

12 Claims, 10 Drawing Figures

DIRECT FIRE WEAPON TRAINER INCORPORATING HIT AND DATA DELAY RESPONSES

BACKGROUND OF THE INVENTION

The invention relates to weapon simulators and more particularly to a laser, automatic weapon firing simulator for training of gunners on automatic burst fire weapons such as a machine gun.

Heretofore there has been a problem of simulating realism in a laser type weapon simulator because of the difference between immediate target hit of the laser beam and the delayed time of flight of an actual ballistic missile. Some attempts have been made to improve realism in this area, one such attempt being evidenced by that prior art which employs the elevation and azimuth of a weapon to determine line of aim at the time of weapon firing. This sytem looks at the target at the time of firing. The time of firing data is then fed into a computer which stores data on ballistics and an evaluation is made to provide an indication of hit or miss. The system does not provide the realism of delay in seeing the target hit as would be seen in fire of live ammunition. Also provision is not made for the realism of effecting successive bursts of fire prior to seeing the effect of a prior burst as would be encountered under actual fire condition.

SUMMARY OF THE INVENTION

Under applicants' invention, elevation and azimuth of the weapon is utilized to determine the line of aim at the time of firing. The system then delays the feeding of this data of position to an electro-optical system which directs the laser beam such that the laser's line of aim is always a delay time after the line of aim of the weapon. The result is that the trainee does not get advance information on a prior firing, i.e., immediate feedback, but must operate under the actual delay of missile flight time which would be encountered in the use of live ammunition.

DESCRIPTION OF THE PREFERRED EMBODIMENT

Figures 1, 1A:
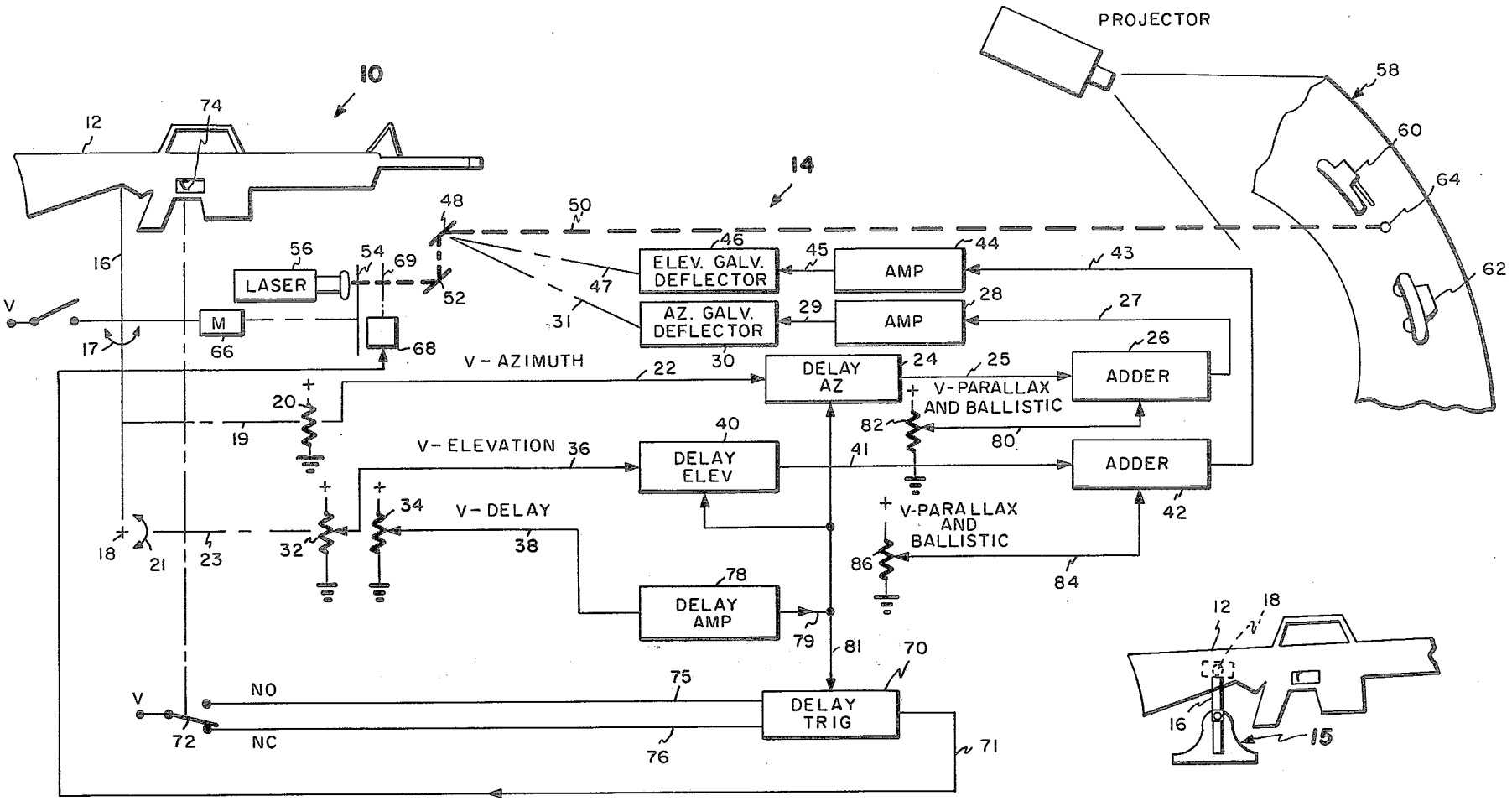
FIG. 1 is a schematic view of a direct fire weapon trainer incorporating the invention.
FIG. 1A is an elevational view of part of a weapon of FIG. 1 showing a suitable dual axis mounting.

Referring to the drawing, in FIG. 1 is shown a schematic arrangement of a direct fire simulation system of an automatic fire weapon, the system incorporating the invention. The simulation system is indicated generally at 10 and comprises the weapon 12 plus the additional circuitry generally indicated at 14 and which in practice is mounted integral with the weapon, partly within the weapon and partly attached to the weapon. The weapon, i.e., the automatic gun 12, is mounted on a suitable mount 15 for rotation in azimuth for a vertical axis 16 and in elevation about a horizontal axis 18. The mounting is indicated schematically in FIG. 1 and in more detail in FIG. 1A. Rotation of the weapon 12 about the vertical axis 16 is indicated by the double headed arrow curve 17 and as indicated by dot-dash line 19 actuates an azimuth potentiometer 20 to provide a voltage azimuth signal on a line 22 to an azimuth delay circuit 24 and thence on lines 25 and 27 through an adder circuit 26 and an amplifier 28 whose output is passed on a line 29 to an azimuth galvanometric deflector 30 which provides one input, as indicated by dot-dash line 31, to a moveable mirror 48.

Elevation and deflection of the weapon 12 by movement about the horizontal axis 18, as indicated by the double headed arrow curve 21, actuates, as indicated by the dot-dash line 23, a set of ganged potentiometers 32 and 34 which are provided, respectively, to produces an elevation voltage on line 36 and a voltage delay signal corresponding to range on line 38. The voltage elevational signal on line 36 is passed to an elevation delay circuit 40 and thence on lines 41, 43 and 45 through an adder 42, and amplifier 44 to an elevation galvanometric deflector 46 which provides, as indicated by dot-dash line 47, an elevation input to the moveable mirror 48. Thus, the azimuth deflector 30 and elevation deflector 46 operate upon the moveable mirror 48 which directs a reflected laser beam 50 in the direction of a target display indicated generally at 58.

The emitter beam (in the present example a laser beam 50) is obtained from a laser source 56 passing its beam through a motorized rotatable shutter 54, past an interrupter means in the form of a solenoid operated shutter 69 and thence to a fixed mirror 52 from which the beam is reflected to the moveable mirror 48. Thus, laser 56 provides a laser beam 50 which is reflected off the fixed mirror 52, thence off the moveable mirror 48 which is under the control of the elevation and azimuth deflectors 46 and 30, and thence to the target screen indicated generally at 58.

Figure 4:
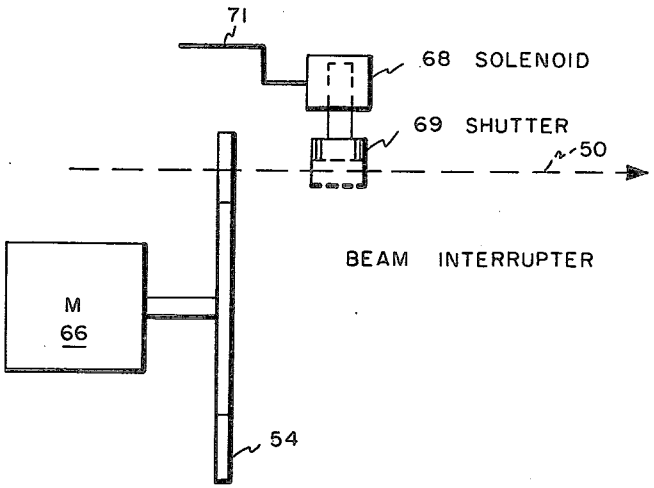
FIG. 4 is a side elevation of a solenoid operated shutter stop used in FIG. 1 to interrupt the laser beam.
Figure 3:
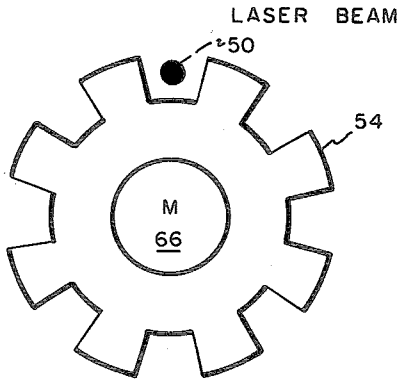
FIG. 3 is an end elevation of a motorized rotatable shutter shown in FIG. 1.

On the screen 58 a motion picture target is presented as indicated by the moving targets 60 and 62. The dot 64 indicates a projectile hit upon the target screen. The rotatable shutter 54 and its actuating mechanism is shown in FIGS. 1, 3 and 4 as being rotated by a motor 66, with the rotation of said shutter 54 causing "hit or miss" dot 64 to be intermittantly displayed on screen 58 at whatever frequency is desired to make weapon 12 appear to be, for example, an automatic rifle, a machine gun, or any other weapon that may be made to fire rapid or other successive shots. The shutter 69 is mechanically moveable into and out of position for the passage or stoppage of the laser beam 50 by means of a shutter solenoid means 68 as shown in FIG. 4. The shutter solenoid which is thus capable of passing and interrupting the laser beam 50 is activated from a trigger delay circuit 70 shown in FIG. 1, via a normally open switch 72 which is indicated in FIG. 1 and actuable to closed position from a trigger 74 of the weapon 12 to pass voltage from a voltage source indicated at V, to the delay trigger circuit 70 via a line 75.

The voltage delay potentiometer 34, which as previously indicated is operated from an elevation actuation of the weapon about the horizontal axis 18, passes its voltage on line 38 through a delay amplifier 78 to each of the three circuits, namely delay elevation 40, delay azimuth 24 and delay trigger 70. This delay voltage, since it is associated with elevation, is a signal which corresponds to target range and acts as a second input to each of the three circuits 24, 40 and 70 to vary the output voltage thereof in accordance with the target range.

Figure 5:
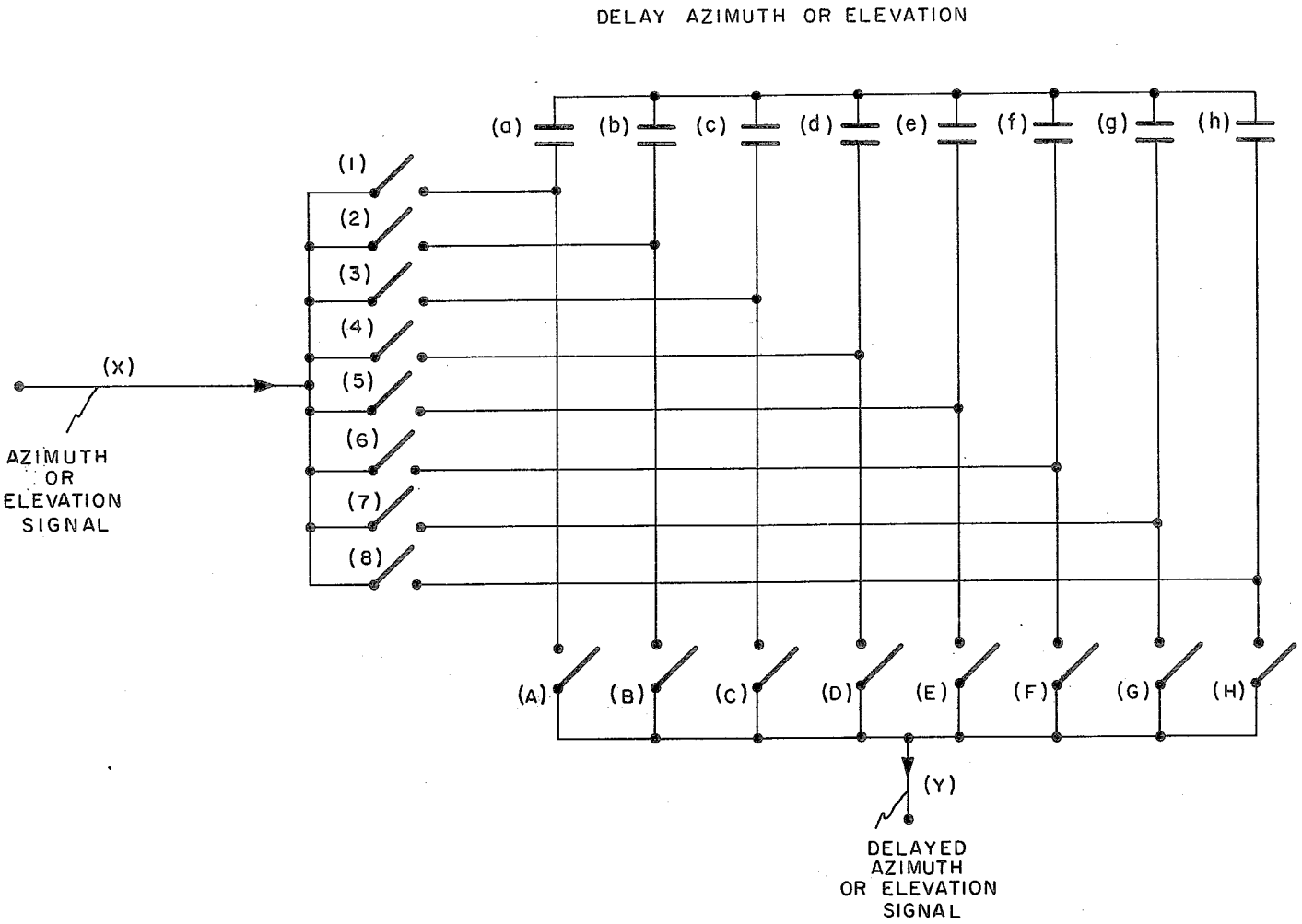
FIG. 5 is a schematic of a wiring diagram of a capacitor changing delay switching portion of a delay means for azimuth or elevation data, the entire circuit being shown in block form in FIG. 1.
Figure 7:
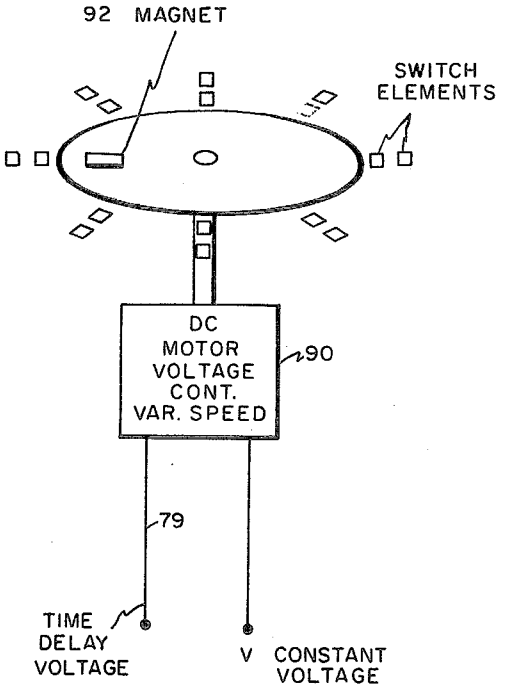
FIG. 7 is a plan view in schematic form showing the D.C. motor drive of the switch mechanism and the delay voltage input which controls the rate of readout and hence time delay in readout.
Figure 6:
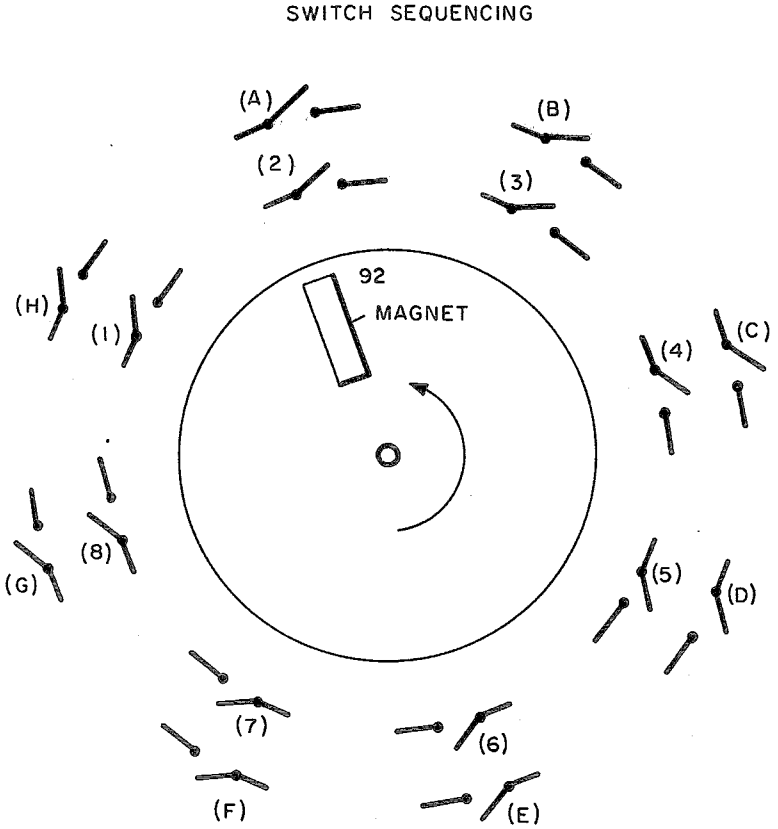
FIG. 6 is a schematic end view of the switch portion of the same data delay mechanism showing how the switches are continuously sequentially closed to provide continuous readout.

The delay azimuth and delay elevation circuits 24 and 40 are delay lines which could be represented by any suitable means, as for example by use of an analog shift register such as Amperex MOS Bucket Brigade Delay Line Number M31. However, a simplified suitable circuit is shown in FIGS. 5, 6 and 7, wherein the delay is accomplished by storing the azimuth or elevation voltage on a capacitor and reading the voltage out of a delayed time later. The circuit of FIG. 5 operates as follows. The elevation or azimuth signal is present continuously at point X. When switch 1 closes, the voltage is immediately transferred to capacitor *a.* Switch 8 then closes, putting a voltage on capacitor *h.* Similarly, all switches are activated in sequence. Correspondingly, when switch 1 closes, switch H closes. Voltage on capacitor *h* is read at point Y. When switch G closes, voltage on capacitor *g* is read at point Y, and the process of charging and readout continues as the switches are sequentially activated.

Figure 2:
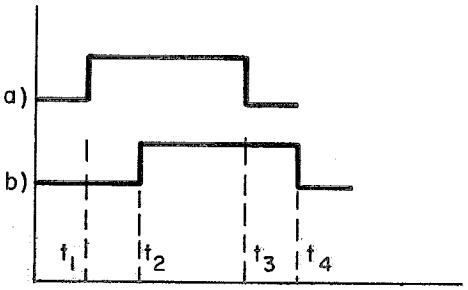
FIG. 2 is pulse curves illustrating the effected time delay of triggered pulse provided in the delay circuit of FIG. 1.

In FIG. 6 the switching mechanism is pictured. A variable speed voltage controlled D.C. motor 90 rotates a magnet 92 which is used to activate read switches 1 – 8 and A – H sequentially. The voltage controlling the speed of the motor, shown in FIG. 7, is generated by the difference between a constant D.C. voltage indicated and the time delayed voltage generated by the time delay amplifier 78 such that long time delays cause the motor to rotate slowly and short time delays cause the motor to rotate rapidly. In specific application to machine guns, the motor rate will vary from 60 rpm to 300 rpm, simulating times of flight from 0.2 to 1.0 seconds. In the control of the moveable mirror 48 which directs the laser beam in relation to the azimuth and elevation movements of the weapon 12, there is also introduced in the adder circuits 26 and 42 respectively, parallax and ballistic data for a specific gun and target range. This data is introduced for the adder 26 on line 80 from a potentiometer 82, and for adder 42 on line 84 from a potentiometer 86. FIG. 2 indicates the operation of the delay trigger circuit 70 in that when the gun trigger 74 (FIG. 1) is activated to close the switch 72, a pulse is provided which begins at time $t_1$ (FIG. 2) and ends at time $t_3$. However, through the delay provided to the delay trigger circuit 70 via the delay amplifier 78, the actual time of pulse derived from the delay trigger circuit 70 and operable upon the shutter solenoid 68 via line 71 is that pulse shown in FIG. 2 at curve *b* and occurring between times $t_2$ and $t_4$.

The advantages of the above described circuit reside in the fact that through the delay circuits 24, 40 and 70, provided as described with respect to FIG. 1, when the weapon is fired the hit upon the target does not occur until a realistic delay time after the firing of the gun. Further, the circuit is flexible via the potentiometer inputs on lines 80 and 84 through adders 26 and 42 from the instructor to vary the ballastic problems for a particular target as well as to provide the necessary parallax corrections for the difference between the line of sight of the rifle barrel and the line of sight of the laser beam 50. The position of the laser spot at the time of impact (after the delay time) is a function of the angular gun position when the trigger is pulled. While the azimuth voltage and elevation voltage are continuously changing with movement of the gun, any subsequent movement of the gun during the delay time will be relayed to the laser position control, i.e., mirror 48, subsequent to the time of impact. Therefore, the trainee can engage a second target without affecting the simulated delay time or point of impact.

Figure 8:
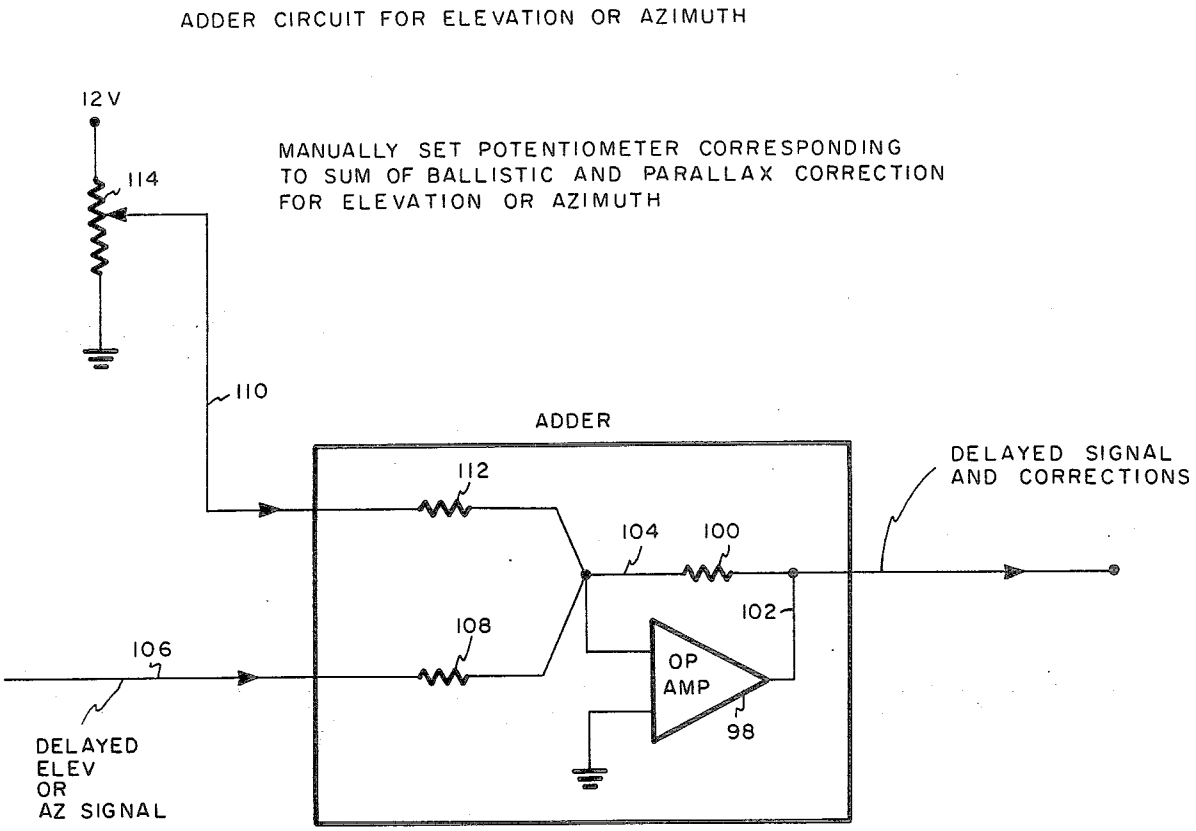
FIG. 8 illustrates one suitable circuit for an adder circuit shown in block form in FIG. 1.
Figure 9:
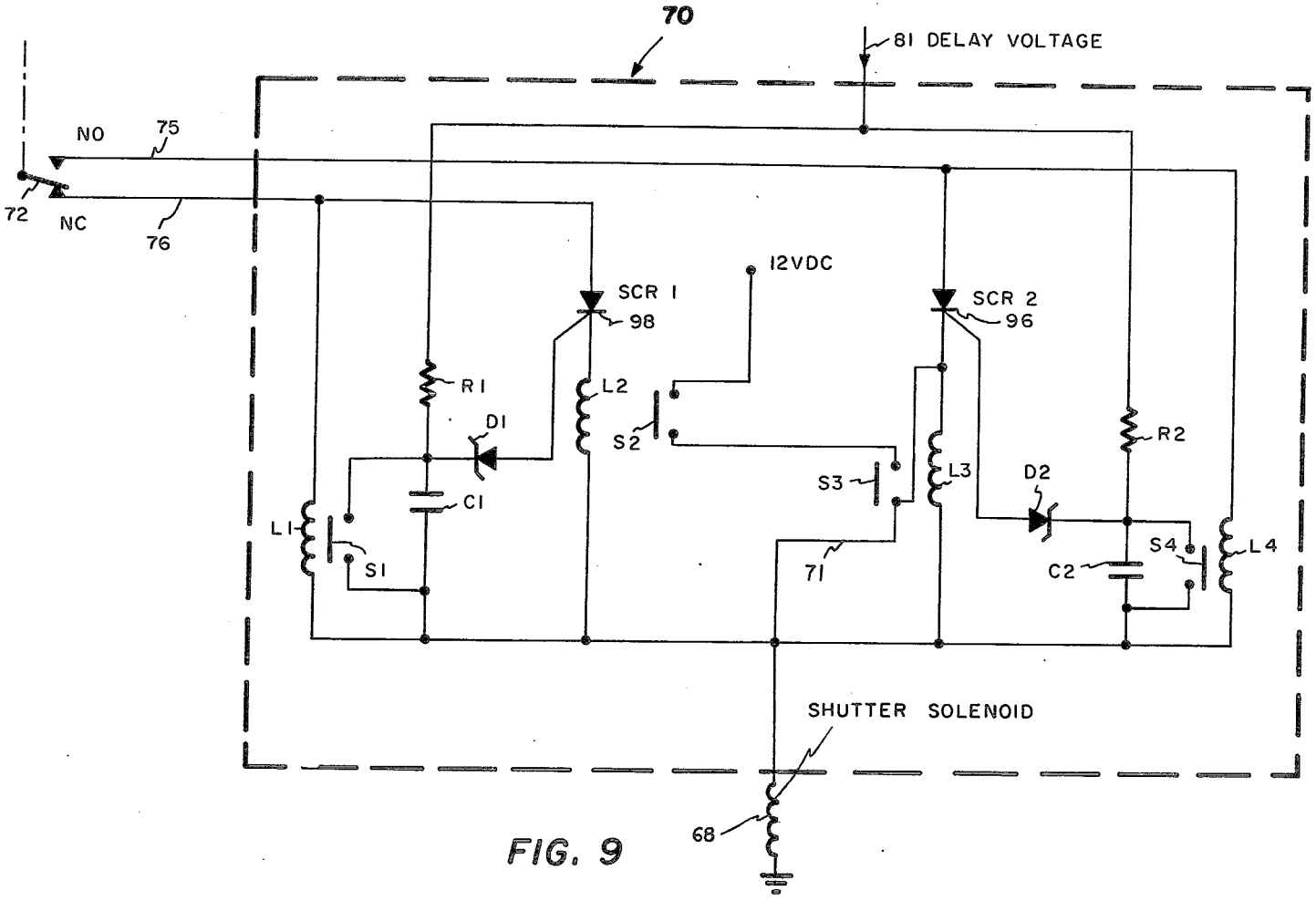
FIG. 9 is a circuit diagram showing one suitable circuit for a delay trigger circuit shown in block form in FIG. 1.

Details of suitable circuits for the azimuth or elevation adders 26 and 42 and the trigger delay circuit 70 are shown respectively in FIGS. 8 and 9.

Referring initially to FIG. 9, the delay trigger circuit 70 is activated from trigger switch 72 via lines 75 and 76 with an input via lines 79 and 81 from the delay amplifier 78 and provides an output via line 71 to the shutter solenoid 68 for operating the shutter 69 (FIG. 1).

More specifically, when trigger 74 of weapon 12 is pulled, trigger switch 72 closes the normally open (NO) circuit line 75 and opens the normally closed (NC) circuit line 76. Input on line 75 energizes relay L4 to open normally closed switch S4. Opening switch S4 causes capacitor C2 to begin to charge, drawing current through $R_2$ from the delay voltage line 81. When voltage on C2 exceeds the breakdown of the zener diode D2, the diode will provide on gate 96 the necessary voltage bias to fire the SCR2. SCR2 when fired activates relay L3 to close normally open switch S3. Closing of switch S3 applies 12V DC power through normally closed switch S2, and the now closed switch S3, to the shutter solenoid 68 and also provides power to maintain relay L3 energized to hold switch S3 closed. The result of the above is that the shutter solenoid 68 is activated to move the shutter 69 (FIG. 1) to open position a delay time after the trigger 74 is pressed and dependent upon the selected values of C2 and R2.

When trigger switch 74 is released, thereby returning switch 72 to its original condition of line 75 open and line 76 closed, relay L3 continues to be activated via closed switch S3. At the same time the energizing of line 76 activates relay L1 which opens normally closed switch S1, allowing capacitor C1 to charge by drawing current through R1 from the delay voltage line 81. When the voltage on C1 exceeds the breakdown voltage of zener diode D1, the gate 98 of SCR1 will fire SCR1 to energize relay L2, thereby opening switch S2 and interrupting energization of relay L3 and shutter solenoid 68 to thereby close shutter 69 (FIG. 1) and interrupt beam 50. Thus, a time delay (determined by the values of C1, R1) after the trigger 74 is released, the shutter solenoid 68 is deactivated and shutter 69 is moved to closed, i.e., beam interrupting position.

Referring to FIG. 8, a suitable adder circuit for azimuth adder 26 or elevation adder 42 is shown as comprising an operational amplifier connected via resistor 100, and lines 102 and 104 is a feedback circuit. The voltage value in the feedback circuit is modulated and responsive to one input via line 106 and resistor 108 from the azimuth or elevation delay circuits 24 and 40, and to a second input via line 110 and resistor 112 to the input feed side of the operational amplifier 98. The potentiometer 114 corresponds to the potentiometer 82 for adder 26 or potentiometer 86 for adder 42.

In summary, the trainer includes a voltage input responsive electro-optical system comprising the mirrors 52, 48, laser source 56 and galvanometric deflectors 46 and 49 with a voltage producing system, slave connected to the weapon and to the electro-optical system as represented by the slave potentiometers 20 and 32, and voltage delay circuit means including the azimuth and elevation delay circuits 24 and 40 and the delay amplifier 78, potentiometer 34, and trigger delay circuit 70 to simulate a time of flight delay in the incidence and position of the laser beam on the display screen to provide realism in both time and location of the effected hit mark upon the display screen.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A weapon fire simulator system for training a marksman to shoot a predetermined weapon accurately at a predetermined target means, comprising in combination:

an imitation weapon having a trigger for effecting the simulated firing thereof;

means slave connected to said weapon for generating a first voltage that represents the elevation thereof with respct to a horizontal plane;

means slave connected to said weapon for generating a second voltage that represents the azimuth thereof with respect to a vertical plane;

means effectively connected to said weapon for generating a third voltage that represents the elevation of said weapon with respect to a horizontal plane;

a first adjustable delay means having a voltage signal input, a control input, and a voltage signal output, with the voltage signal input thereof connected to the output of said first voltage generating means;

a second adjustable delay means having a voltage signal input, a control input, and a voltage signal output, with the voltage signal input thereof connected to the output of said second voltage generating means;

a third delay means having an input and an output, with the input thereof connected to the output of said third voltage generating means, and with the output thereof connected to the control inputs of said first and second adjustable delay means;

a normally open trigger switch having terminals and being connected to the trigger of said weapon in such manner as to be closed upon the firing thereof;

a fourth voltage effectively connected to one of the terminals of said normally open trigger switch;

an adjustable delay trigger circuit having a voltage input, a control input, and an output, with the voltage input thereof connected to the other terminal of said normally open trigger switch, and with the control input thereof connected to the output of said third delay means;

emitter means spatially disposed from said screen for timely projecting a predetermined radiation beam along a predetermined path;

reflective means disposed between the aforesaid screen and said emitter means in the path of the radiation beam projected thereby for effecting the redirection thereof;

normally closed shutter means effectively connected to the output of said adjustable delay trigger circuit and physically disposed in the path of the radiation beam projected by the aforesaid emitter means for effecting the passing of said radiation beam toward said reflector means in response to the delayed fourth voltage from said adjustable delay trigger circuit;

means effectively connected to the outputs of the aforesaid first and second delay means and to said reflective means for indexing the aforesaid projected radiation beam redirected thereby in response to the aforesaid delayed first voltage representing the elevation of said weapon and in response to the aforesaid delayed second voltage representing the azimuth of said weapon in such manner as to position said projected radiation beam on said display screen as a hit or miss mark thereof in correspondence with the aiming of said weapon when said weapon is effectively fired as a result of the aforesaid trigger switch being closed by the pulling of the trigger thereof.

2. The device of claim 1, wherein said predetermined weapon is a gun.

3. The device of claim 1, wherein said target means comprises:

a display screen; and a motion picture projector spatially disposed from said display screen in such manner as to project predetermined target images thereon.

4. The device of claim 1, wherein each of said first, second, and third voltage generating means comprises:

a positive voltage source;

a ground; and a potentiometer having a resistance portion and a movable arm in slidable contact therewith, with the resistance portion thereof connected between said positive voltage source and said ground, and with the movable arm thereof effectively connected to the aforesaid weapon.

5. The device of claim 1, wherein said third delay means comprises a delay amplifier, the delay of which is proportional to the range between the aforesaid predetermined target means and said weapon.

6. The device of claim 1, wherein said emitter means is a laser and said predetermined radiation beam is a laser beam.

7. The device of claim 1, wherein said reflective means comprises at least one mirror.

8. The device of claim 1, wherein said normally closed shutter means comprises:

a shutter; and a solenoid connected to said shutter in such manner as to timely effect the opening and closing thereof.

9. The device of claim 1, wherein said means effectively connected to the outputs of the aforesaid first and second delay means and to said reflective means for indexing the aforesaid projected radiation beam redirected thereby in response to the aforesaid delayed first voltage representing the elevation of said weapon and in response to the aforesaid delayed second voltage representing the azimuth of said weapon in such manner as to position said projected radiation beam on said display screen as a hit or miss mark thereon in correspondence with the aiming of said weapon when said weapon is effectively fired as a result of the aforesaid trigger switch being closed by the pulling of the trigger thereof comprises:

a first galvanometric deflector effectively connected between the output of said first delay means and said reflective means; and a second galvanometric deflector effectively connected between the output of said second delay means and said reflective means.

10. The invention of claim 9, further comprising:

a positive voltage source;

a ground;

a first potentiometer having a resistance portion and a movable arm in slidable contact therewith, with the resistance portion thereof connected between said positive voltage source and said ground;

a first adjustable adder having an input, a control input, and an output, with the input thereof connected to the output of said first delay means, with the control input thereof connected to the movable arm of the aforesaid potentiometer, and with the output thereof connected to the input of said first galvanometric deflector;

another positive voltage source;

a second potentiometer having a resistance portion and a movable arm in slidable contact therewith, with the resistance portion thereof connected between said another positive voltage source and said ground; and a second adjustable adder having an input, a control input, and an output, with the input thereof connected to the output of said second delay means, with the control input thereof connected to the movable arm of the aforesaid potentiometer, and with the output thereof connected to the input of said second galvanometric deflector.

11. The invention of claim 1, further comprising means disposed between said reflective means and said emitter means for chopping the predetermined radiation beam projected thereby at a predetermined frequency.

12. The device of claim 11, wherein said means disposed between said reflective means and said emitter means for chopping the predetermined radiation beam projected thereby at a predetermined frequency comprises:

a rotatable shutter;

a motor connected to said rotatable shutter for the driving thereof at predetermined speeds; and means effectively connected to said motor for controlling the running thereof.

* * * * *